US008552922B2

(12) United States Patent
Igwe

(10) Patent No.: US 8,552,922 B2
(45) Date of Patent: Oct. 8, 2013

(54) HELIX-SPIRAL COMBINATION ANTENNA

(75) Inventor: Christian I. Igwe, Cerritos, CA (US)

(73) Assignee: The Boeing Company, Chicago, IL (US)

( * ) Notice: Subject to any disclaimer, the term of this patent is extended or adjusted under 35 U.S.C. 154(b) by 173 days.

(21) Appl. No.: 13/287,858

(22) Filed: Nov. 2, 2011

(65) Prior Publication Data

US 2013/0106664 A1 May 2, 2013

(51) Int. Cl.
*H01Q 1/28* (2006.01)
*H01Q 1/36* (2006.01)

(52) U.S. Cl.
USPC ..... 343/895; 343/705

(58) Field of Classification Search
USPC ..... 343/705, 775, 895
See application file for complete search history.

(56) References Cited

U.S. PATENT DOCUMENTS

| | | | | |
|---|---|---|---|---|
| 4,608,572 | A * | 8/1986 | Blakney et al. | 343/792.5 |
| 4,630,064 | A | 12/1986 | Andrews et al. | |
| 5,216,436 | A * | 6/1993 | Hall et al. | 343/895 |
| 5,353,040 | A | 10/1994 | Yamada et al. | |
| 5,479,182 | A * | 12/1995 | Sydor | 343/895 |
| 6,819,302 | B2 * | 11/2004 | Volman | 343/895 |
| 6,937,203 | B2 | 8/2005 | Rao et al. | |
| 7,113,146 | B2 | 9/2006 | Pearlman et al. | |
| 7,151,505 | B2 * | 12/2006 | Jostell et al. | 343/895 |
| 7,151,509 | B2 | 12/2006 | Massey et al. | |
| 7,388,599 | B2 | 6/2008 | Kim | |
| 2003/0043071 | A1 | 3/2003 | Lilly et al. | |
| 2007/0097006 | A1 | 5/2007 | Brown et al. | |
| 2011/0248894 | A1 * | 10/2011 | Crowley et al. | 343/702 |

FOREIGN PATENT DOCUMENTS

| | | | |
|---|---|---|---|
| GB | 2443308 | A | 4/2008 |
| JP | 2004254168 | | 9/2004 |
| JP | 2009278591 | | 11/2009 |
| WO | 03107483 | A1 | 12/2003 |

OTHER PUBLICATIONS

Donn, C., IEEE Transactions on Antennas and Propagation, vol. AP-28, No. 2, Mar. 1980, pp. 264-267.
Angelakos, D.J., et al, Modifications on the Axial-Mode Helical Angenna, Proceedings of IEEE, Letters, pp. 558-559.
Hansen, R.C. (2004), Non-Foster and Connected Planar Arrays, Radio Sci., 39, RS4004, doi. 10.1029/2004RS003043.
Schaubert, D.H., et al., Vivaldi Antenna Arrays for Wide Bandwidth and Electronic Scanning, IEEE AP-S EuCAP 2007 Conference paper.

* cited by examiner

*Primary Examiner* — Tan Ho
(74) *Attorney, Agent, or Firm* — Caven & Aghevli LLC

(57) ABSTRACT

Compound antennas are disclosed, as are aircraft comprising compound antennas and methods to use compound antennas. In one embodiment, a compound antenna comprises a ground plane, a helix antenna element comprising a first dielectric core having a first end and a second end and coupled to the ground plane at the first end, the helix antenna element exhibiting a normal mode polarization pattern, and a conical spiral antenna element disposed proximate the helix antenna element, the conical spiral antenna element exhibiting an axial mode polarization pattern, wherein both the normal-mode and the axial mode patterns are circular polarization patterns and have the same sense. Other embodiments may be described.

20 Claims, 4 Drawing Sheets

HELIX-SPIRAL COMBINATION ANTENNA

BACKGROUND

The subject matter described herein relates to electronic communication and sensor systems and specifically to configurations for antennas for use in such systems.

The Global Positioning System (GPS) is a space-based, world-wide navigation system which includes a space, ground, and user segment. The locations of the satellites are used as reference points to calculate positions of the GPS user receiver, which is usually accurate to within meters and sometimes even within centimeters. In telemetry and tracking systems, including GPS, it is desirable to maintain communication at all times. Antennas which provide a spherical radiation profile, when mated to transmitters such as GPS transmitters, are suitable for maintaining substantial communication.

SUMMARY

In one embodiment, a compound antenna comprises a ground plane, a helix antenna element comprising a first dielectric core having a first end and a second end and coupled to the ground plane at the first end, the helix antenna element exhibiting a normal mode polarization pattern, and a conical spiral antenna element disposed proximate the helix antenna element, the conical spiral antenna element exhibiting an axial mode polarization pattern, wherein the first polarization pattern and the second polarization pattern are circular polarization patterns and have the same sense.

In another embodiment, an aircraft comprises a communication system, and a compound antenna comprising a ground plane, a helix antenna element comprising a first dielectric core having a first end and a second end and coupled to the ground plane at the first end, the helix antenna element exhibiting a normal mode polarization pattern, and a conical spiral antenna element disposed proximate the helix antenna element, the conical spiral antenna element exhibiting an axial mode polarization pattern, wherein the first polarization pattern and the second polarization pattern are circular polarization patterns and have the same sense.

In another embodiment, method to use an antenna assembly comprises providing a compound antenna comprising: a ground plane, a helix antenna element comprising a first dielectric core having a first end and a second end and coupled to the ground plane at the first end, the helix antenna element exhibiting a normal mode polarization pattern, and a conical spiral antenna element disposed proximate the helix antenna element, the conical spiral antenna element exhibiting an axial mode polarization pattern, wherein the first polarization pattern and the second polarization pattern are circular polarization patterns and have the same sense, and coupling a feed network to the helix antenna element and the conical spiral antenna element.

Further areas of applicability will become apparent from the description provided herein. It should be understood that the description and specific examples are intended for purposes of illustration only and are not intended to limit the scope of the present disclosure

BRIEF DESCRIPTION OF THE DRAWINGS

Embodiments of methods and systems in accordance with the teachings of the present disclosure are described in detail below with reference to the following drawings.

DETAILED DESCRIPTION

Configurations for compound antennas suitable for use in communication systems, and aircraft systems incorporating such communication systems are described herein. Specific details of certain embodiments are set forth in the following description and the associated figures to provide a thorough understanding of such embodiments. One skilled in the art will understand, however, that alternate embodiments may be practiced without several of the details described in the following description.

The invention may be described herein in terms of functional and/or logical block components and various processing steps. For the sake of brevity, conventional techniques related to data transmission, signaling, network control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

The following description may refer to components or features being "connected" or "coupled" or "bonded" together. As used herein, unless expressly stated otherwise, "connected" means that one component/feature is in direct physical contact with another component/feature. Likewise, unless expressly stated otherwise, "coupled" or "bonded" means that one component/feature is directly or indirectly joined to (or directly or indirectly communicates with) another component/feature, and not necessarily directly physically connected. Thus, although the figures may depict example arrangements of elements, additional intervening elements, devices, features, or components may be present in an actual embodiment.

Figure 1A:
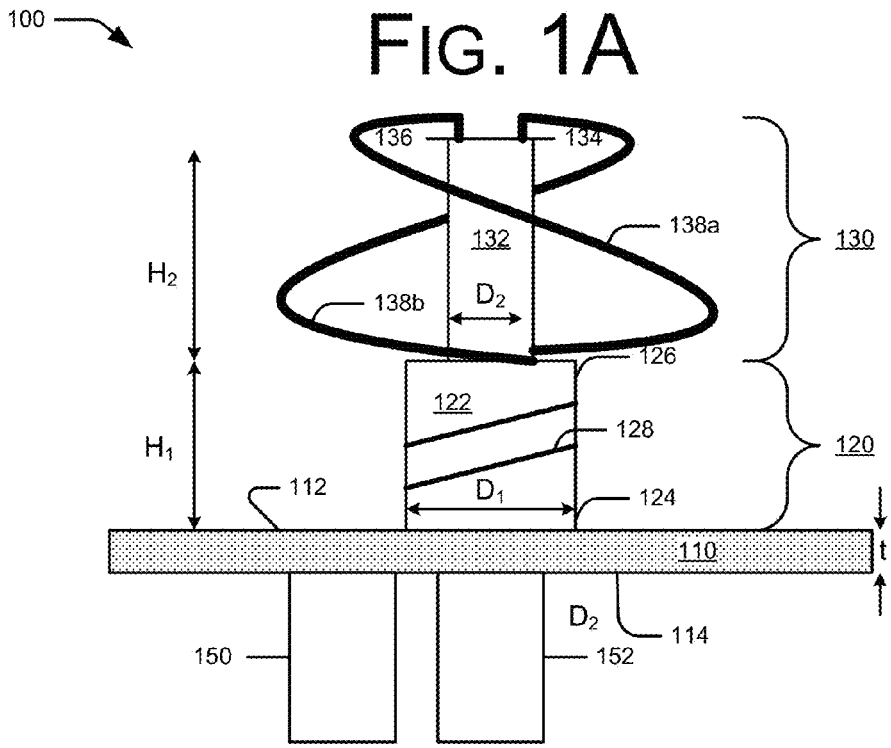
FIG. 1A is a schematic side elevation view of a compound antenna, according to embodiments.
Figure 1B:
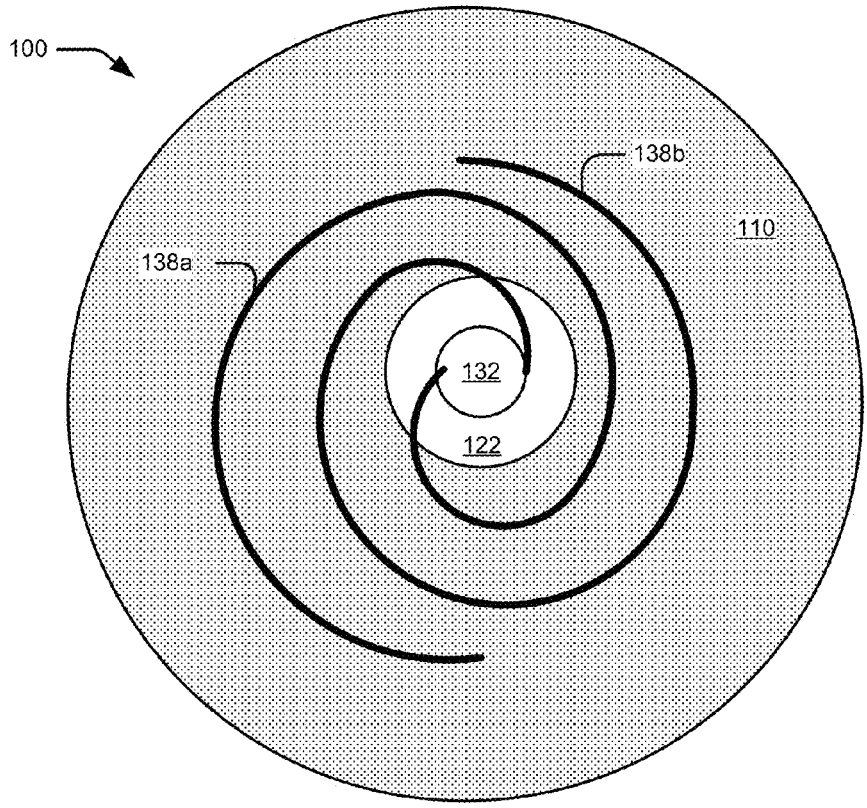
FIG. 1B is a schematic top-view of the compound antenna depicted in FIG. 1A.

FIG. 1A is a schematic side elevation view of a compound antenna, according to embodiments, and FIG. 1B is a schematic top-view of the compound antenna depicted in FIG. 1A. Referring to FIGS. 1A-1B, in some embodiments compound antenna 100 comprises a ground plane 110. A helix antenna element 120 comprises a first dielectric core 122 having a first end 124 and a second end 126 and is coupled to the ground plane 110 at the first end 124. A conical spiral antenna 130 comprising a second dielectric core 132 is disposed proximate the helix element 120. In the embodiment depicted in FIG. 1 the conical spiral antenna 130 is mounted to the helix antenna 120 such that the second dielectric core 132 is disposed on the first dielectric core 122. In other embodiments the conical spiral antenna 130 may be positioned adjacent or otherwise proximate to the helix antenna element 120.

Helix antenna element 120 comprises a dielectric core 122 and a conductive element 128 wrapped around the dielectric core 122 in a helix pattern to form a number, n, of turns, wherein the number n is between 1 and 4. Dielectric core 122 may be formed from a suitable low k material such as, e.g., fiberglass or the like, and the conductive elements 128 may be formed from any suitable conductive material, e.g., a copper wire or tape or the like. In some embodiments the height $H_1$ of dielectric core 122 measures between about 0.5 inches and 1.5 inches and the diameter $D_1$ of dielectric core 122 measures between about between about 0.5 inches and 1 inch. In other embodiments the helix antenna element 120 is adapted to operate in a frequency range extending from about 1700 MHz to 2300 GHz, (e.g., a wavelength of about 6.9 inches to 5.1 inches). In such embodiments the height $H_1$ of the dielectric core 122 measures between about 1.2 inches (30.5 mm) and 0.9 inches (22.9 mm) and the diameter, $D_1$, of the dielectric core 122 measures approximately 0.7 inches (17.8 mm). One skilled in the art will recognize that the particular dimensions of the helix antenna element 120 may be a function of the design frequency as well as materials and physical configuration. In general, the helix antenna element 120 may be short when compared to the design wavelength range of the helix antenna element 120.

Conical spiral antenna 130 comprises dielectric core 132 and a first radiating element 138*a* and a second radiating element 138*b* formed in a spiral around the dielectric core 132. In some embodiments the dielectric core 132 may be integrated with the dielectric core 122, while in other embodiments the dielectric core 132 may be an independent component mounted on the dielectric core 122. Dielectric core 132 may be formed from a suitable low k material such as, e.g., fiberglass or the like, and the conductive elements 138*a*, 138*b* may be formed from any suitable conductive material, e.g., a copper wire or tape or the like. In some embodiments the height $H_2$ of dielectric core 132 measures between about 5 inches and 7 inches and the diameter $D_2$ of dielectric core 132 measures between about between about 3 inches and 4 inches. In other embodiments the conical spiral antenna element 130 is adapted to operate in a frequency range extending from about 1700 MHz to 2300 GHz, (e.g., a wavelength of about 6.9 to 5.1). In such embodiments the height $H_2$ of the dielectric core 122 measures between about 5.7 inches (144.8 mm) and 6.1 inches (154.9 mm) and the diameter, $D_2$, of the dielectric core 122 measures approximately 4.0 inches (101.6 mm). One skilled in the art will recognize that the particular dimensions of the conical spiral antenna element 130 may be a function of the design frequency as well as materials and physical configuration.

A first feed 150 is coupled to the helix antenna element 120 and a second feed 152 is coupled to the conical spiral antenna element 130. In the embodiment depicted in FIGS. 1A and 1B the antenna elements 120, 130 are fed by separate feed networks. In alternate embodiments the antenna elements 120, 130 may be fed by a single feed, e.g., by using a power divider. In the embodiment depicted in FIG. 1 the helix antenna element 120 is fed at the base of the antenna element 120 while the conical spiral antenna element 130 is fed at the top of the element 130.

Figure 2:
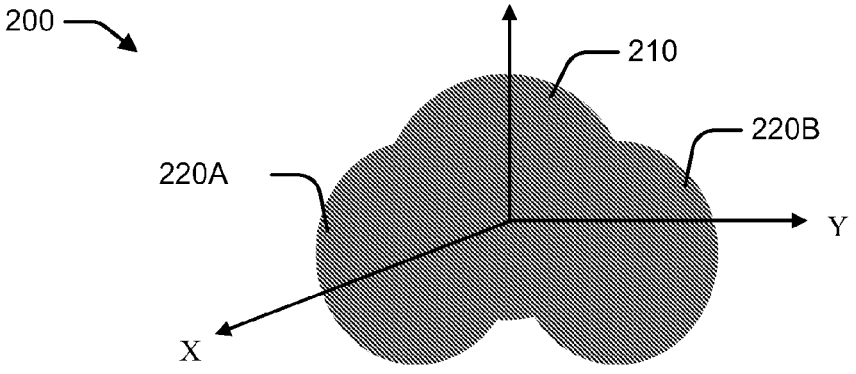
FIG. 2 is a schematic illustration of a radiation pattern generated by the compound antenna depicted in FIG. 1 and FIG. 1B.

FIG. 2 is a schematic illustration of a radiation pattern generated by the compound antenna 100 depicted in FIG. 1 and FIG. 1B. Referring to FIG. 2, the compound antenna 100 produces a three-lobed radiation pattern in which the three lobes are substantially directional and overlapping. The conical spiral antenna 130 produces a single lobe axial-mode radiation pattern 210, while the helix antenna element 120 produces two displaced normal-mode radiation patterns 220A, 220B, i.e. a dual lobe radiation pattern.

The helix antenna element 120 and the conical spiral antenna element 130 each produce a radiation pattern which has circular polarization. The quasi-spherical radiation pattern achieved by this design is attained by combining the axial made radiation of the Conical Spiral Antenna with the Normal-Mode radiation of the Helix Antenna. The antenna elements depicted in FIGS. 1 and 2 are constructed to exhibit a right-handed circular polarization sense. One skilled in the art will recognize that alternate embodiments of the physical structure may be implemented to generate alternate polarization senses. By way of example, the orientation of the helix may be changed to change the polarization pattern of the helix antenna element 120. Similarly, the orientation of the spirals may be changed in the conical spiral antennal element 130 to change the polarization orientation of the antenna. Alternatively, the conical spiral antenna element 130 may be fed from bottom to change the polarization orientation of the conical spiral antenna element 130. The specific physical implementation may be varied, provided the antenna elements are constructed to be circularly polarized and with the same orientation.

Figure 3:
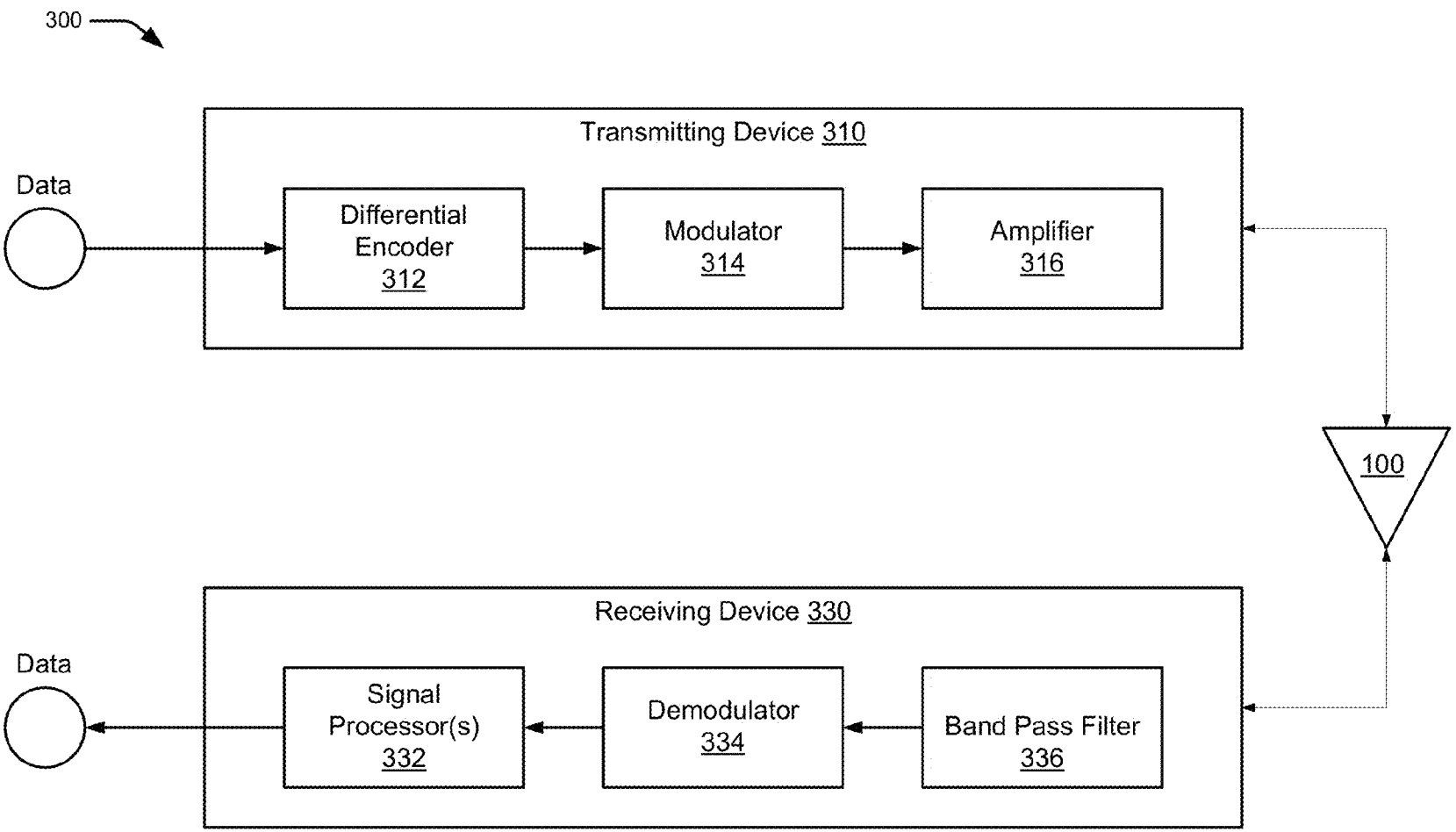
FIG. 3 is a schematic illustration of components of a transmitting device and a receiving device, according to embodiments.

A compound antenna 100 as described with reference to FIGS. 1A and 1B may be incorporated into a communication system. FIG. 3 is a schematic illustration of components of a communication system 300 comprising a transmitting device 310 and a receiving device 330, according to embodiments. Referring to FIG. 3, in one embodiment a transmitting device 310 comprises a differential encoder 312, a modulator 314, and an amplifier 316. A receiving device 330 comprises one or more signal processor(s) 332, a demodulator 334, and a band pass filter 336. The transmitting device 310 and the receiving device 330 are coupled to an antenna 100 as depicted in FIGS. 1A-1B.

Figure 4:
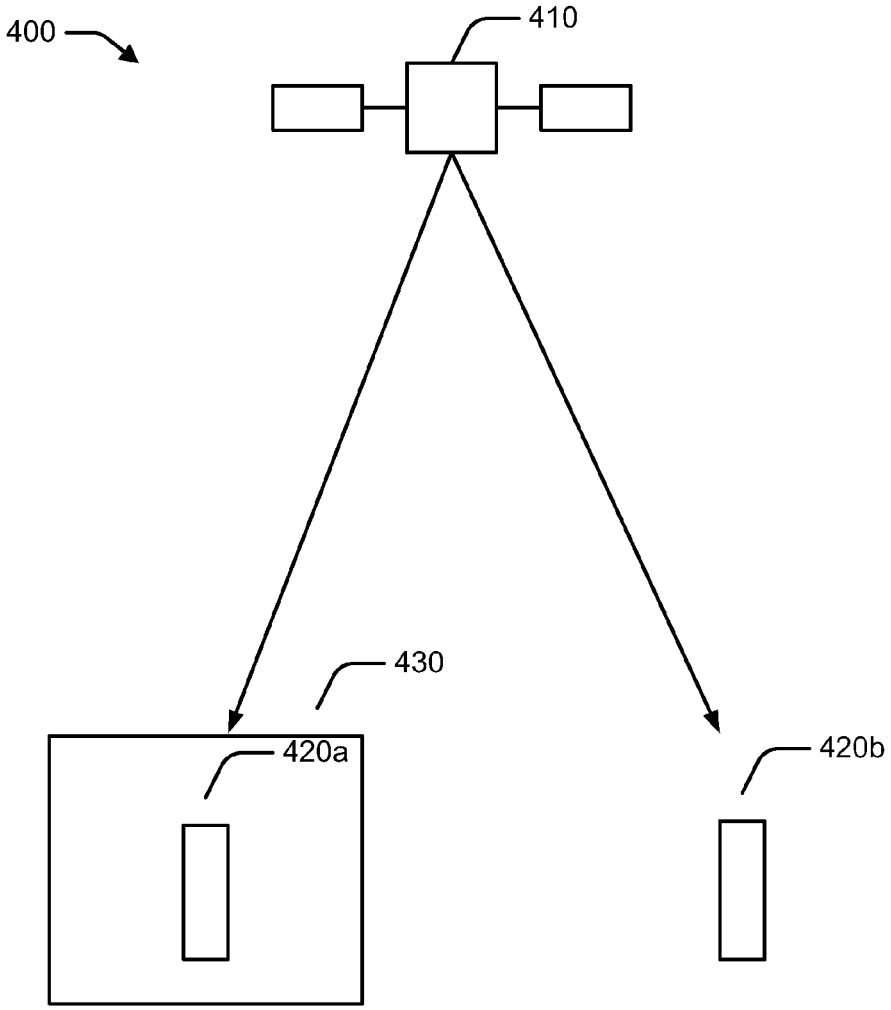
FIG. 4 is a schematic illustration of a low Earth orbit (LEO) satellite communication system, according to embodiments.

In some embodiments a communication system 300 may be incorporated into a communication network such as, e.g., a low Earth orbit (LEO) satellite communication network 400, according to embodiments. Referring to FIG. 4, in some embodiments a network 400 comprises one or more LEO satellites 410 in communication with one or more receiving devices 420*a*, 420*b*, which may be referred to generally by the reference numeral 420. In some embodiments the LEO satellites 410 may be embodied as satellites in the Iridium satellite constellation.

Receiving devices 120 may be implemented as communication devices such as satellite or cellular phones or as components of a communication or computing device, e.g., a personal computer, laptop computer, personal digital assistant or the like. Alternatively, receiving devices 120 may be implemented as position locating or navigation devices analogous to devices used in connection with the global positioning system (GPS). The GPS system utilizes spread-spectrum access techniques which enables the receivers to pick up a signal even when the received broadcast is below the noise floor. In systems such as GPS, pseudo-random codes are broadcast by satellites, and correlation techniques are used to pull the signal out of the noise.

Figure 5:
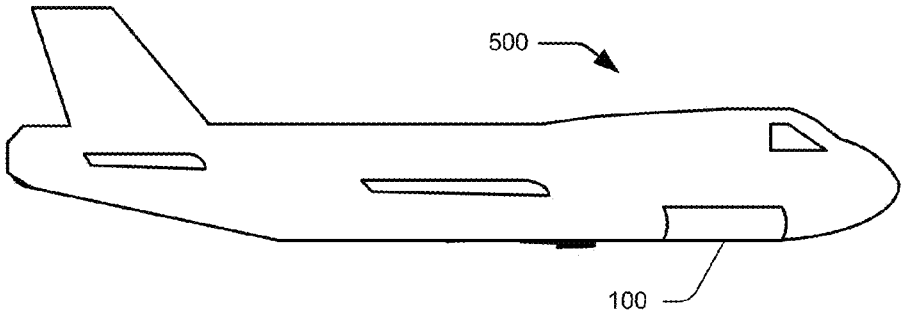
FIG. 5 is a schematic illustration of an aircraft incorporating a compound antenna, according to embodiments.

Referring to FIG. 5, in other embodiments one or more compound antennas 100 constructed according to embodiments described herein may be mounted on an aircraft 500, such as an airplane, helicopter, spacecraft, space vehicle, a satellite, or a launch vehicle or the like. In alternate embodiments compound antenna 100 may be mounted on a ground-based vehicle such as a truck, tank, train, or the like, or on a water-based vehicle such as a ship. In further embodiments a compound antenna 100 may be mounted on a land-based communication station.

Figure 6:
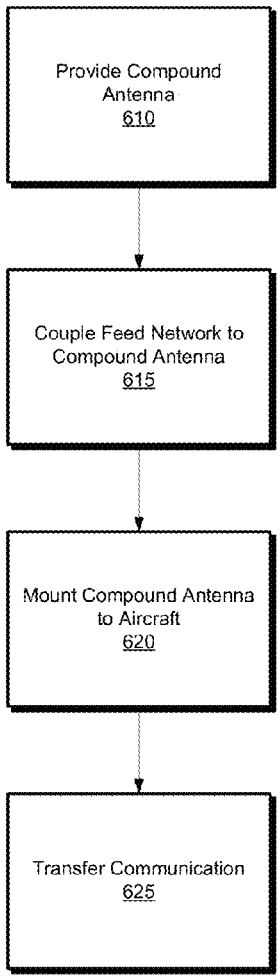
FIG. 6 is a flowchart illustrating operations in a method to use an antenna assembly, according to embodiments.

FIG. 6 is a flowchart illustrating operations in a method to use an antenna assembly, according to embodiments. Referring to FIG. 6, at operation 610 a compound antenna in accordance with the descriptions herein is provided. At operation 615 one or more feed networks are coupled to the compound antenna, e.g., by coupling one or more feed networks which are, in turn, coupled to a communication system, as described above. At operation 620 the compound antenna is mounted to an aircraft, and at operation 625 communication is transmitted and/or received via the compound antenna.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A compound antenna, comprising:

a ground plane;

a helix antenna element comprising a first dielectric core having a first end and a second end and coupled to the ground plane at the first end, the helix antenna element exhibiting a first normal mode polarization pattern; and a conical spiral antenna element disposed proximate the helix antenna element, the conical spiral antenna element exhibiting a second axial mode polarization pattern;

wherein the first polarization pattern and the second polarization pattern are circular polarization patterns and have the same sense.

2. The compound antenna of claim 1, further comprising:

a first feed coupled to the helix antenna element; and a second feed coupled to the conical spiral antenna element.

3. The compound antenna of claim 1, wherein the helix antenna element comprises a conductive element wrapped around the first dielectric core in a helix pattern to form a number, n, of turns, wherein the number n is between 1 and 4.

4. The compound antenna of claim 3, wherein:

the first dielectric core measures between 0.5 and 1.5 inches in height and 0.5 and 1.0 inches in diameter.

5. The compound antenna of claim 1, wherein the conical spiral antenna comprises a second dielectric core coupled to the first dielectric core of the helix antenna element and a first radiating element and a second radiating element formed in a spiral around the second dielectric core.

6. The compound antenna of claim 5, wherein:

the first dielectric core measures between 5 and 7 inches in height.

7. The compound antenna of claim 5, wherein:

the second dielectric core is integrated with the first dielectric core.

8. The compound antenna of claim 1, wherein:

the conical spiral antenna element provides a single-lobe axial-mode radiation pattern; and the helix antennal element provides a dual-lobe normal-mode radiation.

9. An aircraft, comprising:

a communication system; and a compound antenna coupled to the communication system, comprising:

a ground plane;

a helix antenna element comprising a first dielectric core having a first end and a second end and coupled to the ground plane at the first end, the helix antenna element exhibiting a first normal mode polarization pattern; and a conical spiral antenna element disposed proximate the helix antenna element, the conical spiral antenna element exhibiting a second axial mode polarization pattern;

wherein the first polarization pattern and the second polarization pattern are circular polarization patterns and have the same sense.

10. The aircraft of claim 9, wherein the compound antenna further comprises:

a first feed coupled to the helix antenna element; and a second feed coupled to the conical spiral antenna element.

11. The aircraft of claim 9, wherein the helix antenna element comprises a conductive element wrapped around the first dielectric core in a helix pattern to form a number, n, of turns, wherein the number n is between 1 and 4.

12. The aircraft of claim 11, wherein:

the first dielectric core measures between 0.5 and 1.5 inches in height and 0.5 and 1.0 inches in diameter.

13. The aircraft of claim 9, wherein the conical spiral antenna comprises a second dielectric core coupled to the first dielectric core of the helix antenna element and comprises a first radiating element and a second radiating element formed in a spiral around the second dielectric core.

14. The aircraft of claim 13, wherein:

the dielectric core measures between 5 and 7 inches in height.

15. The aircraft of claim 13, wherein:

the second dielectric core is integrated with the first dielectric core.

16. The aircraft of claim 9, further comprising a feed network coupled to the compound antenna.

17. The aircraft of claim 9, wherein the aircraft comprises at least one of an airplane, a space vehicle, a satellite, or a launch vehicle.

18. A method to use an antenna assembly, comprising:

providing a compound antenna comprising:

a ground plane;

a helix antenna element comprising a first dielectric core having a first end and a second end and coupled to the ground plane at the first end, the helix antenna element exhibiting a first normal-mode polarization pattern; and a conical spiral antenna element disposed proximate the helix antenna element, the conical spiral antenna element exhibiting a second axial mode polarization pattern;

wherein the first polarization pattern and the second polarization pattern are circular polarization patterns and have the same sense; and coupling a feed network to the helix antenna element and the conical spiral antenna element.

19. The method of claim 18, further comprising:

mounting the antenna assembly to an aircraft or other naval or ground based platforms.

20. The method of claim 19, wherein:

the conical spiral antenna element provides a single-lobe radiation pattern that is along the axis of the spiral; and the helix antennal element provides a dual-lobe radiation pattern, wherein the dual lobes are normal to the axis of the Helix.

* * * * *